United States Patent [19]

Sauerwald et al.

[11] Patent Number: 4,770,024

[45] Date of Patent: Sep. 13, 1988

[54] DEVICE FOR MANUFACTURING PRESSED SHAPES OR SIMILAR STRUCTURES

[75] Inventors: Walter Sauerwald; Manfred Reyer; Heinz-Dietmar Orth, all of Dortmund, Fed. Rep. of Germany

[73] Assignee: Hoesch Maschinenfabrik Deutschland AG, Dortmund, Fed. Rep. of Germany

[21] Appl. No.: 25,615

[22] Filed: Mar. 13, 1987

[30] Foreign Application Priority Data

Mar. 20, 1986 [DE] Fed. Rep. of Germany ..... 8607727

[51] Int. Cl.[4] ..... B21D 43/00

[52] U.S. Cl. ..... 72/422; 414/749

[58] Field of Search ..... 72/422, 424; 414/749, 414/751, 752

[56] References Cited

U.S. PATENT DOCUMENTS

| | | | |
|---|---|---|---|
| 2,122,648 | 7/1938 | Johnson | 72/422 |
| 2,763,167 | 9/1956 | Sahlin | 72/422 |
| 3,113,767 | 12/1963 | Halberstadt | 414/749 |

*Primary Examiner*—Lowell A. Larson
*Attorney, Agent, or Firm*—Max Fogiel

[57] ABSTRACT

An arrangement for manufacturing pressed shapes and similar structures in which loading and unloading arms are driven by displacement drive mechanisms. These displacement drive mechanisms have at least two displacement cylinders with strokes that are shorter than either the displacement path of the loading arm or the displacement path of the unloading arm. There is no force transmission from the cylinders to the loading and unloading arms to provide for minimum use of driving power during acceleration intervals when the loading and unloading arms move from a stationary position to a displacement speed.

7 Claims, 2 Drawing Sheets

DEVICE FOR MANUFACTURING PRESSED SHAPES OR SIMILAR STRUCTURES

The innovation concerns a device for manufacturing pressed shapes or similar structures with a press, a loading mechanism, and an unloading mechanism, whereby a loading arm driven by a displacement drive mechanism is employed to load the press and an unloading arm driven by a displacement drive mechanism is employed to unload the press.

The loading and unloading arms in a known device of the aforesaid type are each driven by a displacement drive mechanism powered by an electric motor.

A displacement drive mechanism of this type, which must twice accelerate the loading and unloading arms to maximum velocity from a standstill and twice decelerate them from maximum velocity back to standstill again during each press cycle, is, however, due to its high centrifugal :nass, appropriate only for relatively low displacement speeds.

Low displacement speeds on the part of the loading and unloading arms, however, are deleterious to the press's loading and unloading times.

The object of the innovation is to provide displacement drive mechanisms for both the loading and the unloading arms that will allow the press to be loaded and unloaded rapidly.

This object is attained in accordance with the innovation in that both the displacement drive mechanism for the loading arm and the displacement drive mechanism for the unloading arm consist of at least two displacement cylinders with strokes that are shorter than either the path of displacement of the loading arm or the path of displacement of the unloading arm.

In accordance with another characteristic of the innovation, two pressure-application mechanisms that maintain the loading arm and the unloading arm at the limits of their paths of displacement are associated with each displacement drive mechanism.

Each pressure-application mechanism has a pressure-application cylinder and a pressure-application lever.

Each pressure-application lever has a pressure-application roller.

Every displacement cylinder is in a practical way a pneumatic cylinder.

Figure 1:
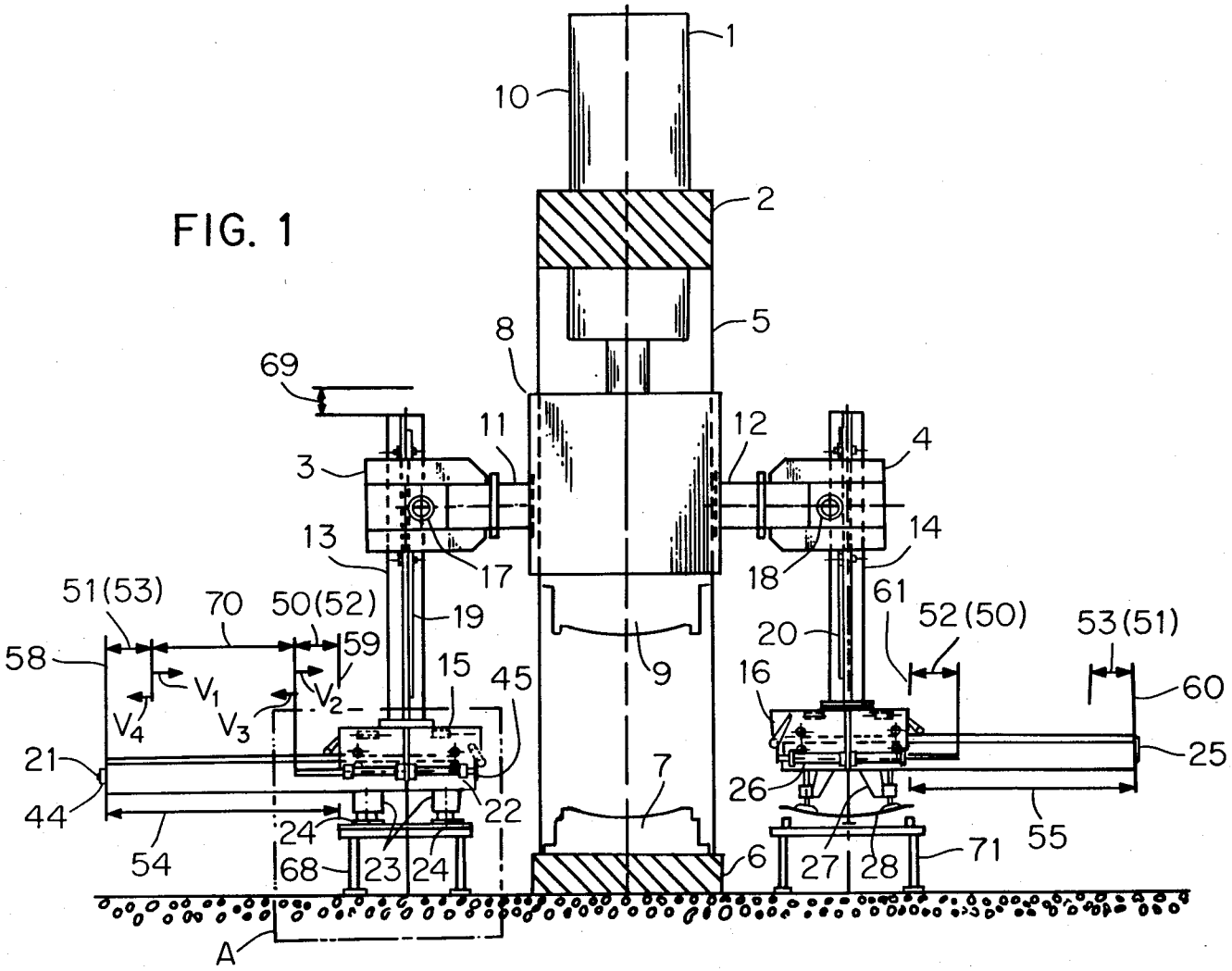
Figure 2:
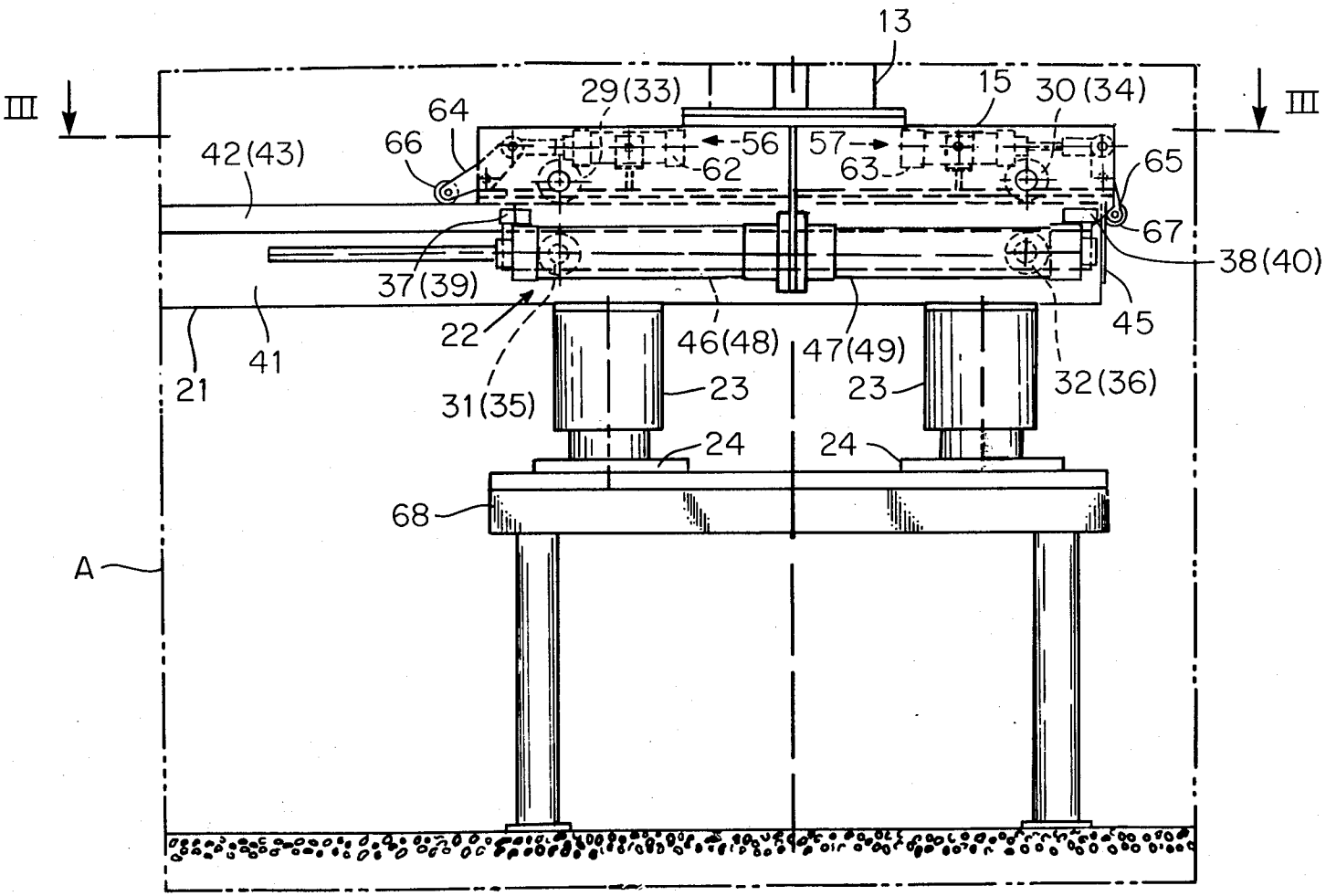

One embodiment of the innovation will now be specified with reference to the schematic drawings, wherein FIG. 1 is a section through a device for manufacturing pressed shapes and FIG. 2 is a larger-scale detail of the area A in FIG. 1.

Figure 3:
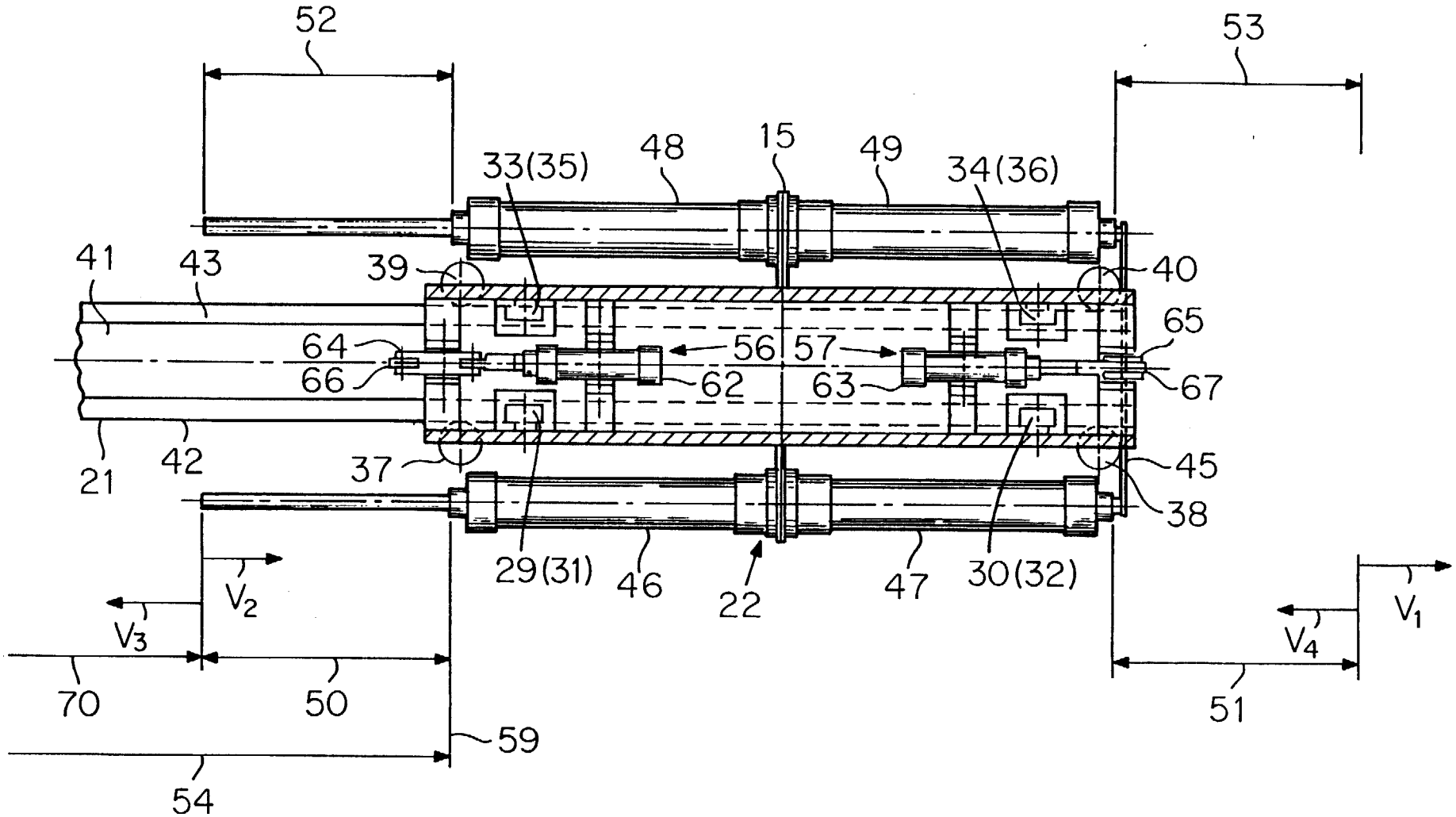

FIG. 3 is a section taken along line III—III in FIG. 2.

A device 1 for manufacturing pressed shapes comprises a hydraulic press 2, a loading mechanism 3, and an unloading mechanism 4.

Hydraulic press 2 has a frame 5 with a lower crossarm 6 that has a lower forming tool 7 mounted on it.

An upper forming tool 9 is secured to a displaceable press crossarm 8. Displaceable press crossarm 8 is driven by a pressure-application cylinder 10.

Both loading mechanism 3 and unloading mechanism 4 have respectively an extension arm 11 and 12 secured to press frame 5, a column 13 and 14 that can be raised and lowered, and a positioning beam 15 and 16.

The column 13 in loading mechanism 3 is rigidly secured to positioning beam 15 and the column 14 in unloading mechanism 4 to positioning beam 16.

Columns 13 and 14 are raised and lowered by motors 17 and 18 through racks 19 and 20 and pinions (unillustrated).

Positioning beam 15 functions as a horizontal guide for a loading arm 21 and as an accommodation for a displacement drive mechanism 22 for that arm. A mechanism 23 for picking up and laying down a blank 24 is mounted on loading arm 21.

Positioning beam 16 functions as a horizontal guide for an unloading arm 25 and as an accommodation for a displacement drive mechanism 26 for that arm. A mechanism for picking up and laying down a finished shape 28 is mounted on unloading arm 25.

Positioning beam 15 is identical in design with positioning beam 16, loading arm 21 with unloading arm 25, and displacement drive mechanism 22 with displacement drive mechanism 26.

Each positioning beam 15 and 16 has eight positioning rollers 29, 30, 31, 32, 33, 34, 35, and 36 with horizontal axes of rotation and four positioning rollers 37, 38, 39, and 40 with vertical axes of rotation.

Both loading arm 21 and unloading arm 25 consist of three lengths 41, 42, and 43 of structural section with a triangular cross-section and of two end pieces 44 and 45.

Each displacement drive mechanism 22 and 26 consists of four displacement cylinders 46, 47, 48, and 49 with strokes 50, 51, 52, and 53 that are shorter than either the path 54 of displacement of the loading arm or the path :55, of displacement of the unloading arm.

Displacement cylinders 46 through 49 are identical pneumatic cylinders.

Associated with each displacement drive mechanism 22 and 26 are two pressure-application mechanisms that maintain loading arm 21 and unloading arm 25 in their limiting positions 58, 59, 60, and 61.

Each pressure-application mechanism 56 and 57 contains respectively a pressure-application cylinder 62 and 63, a pressure-application lever 64 and 65, and a pressure-application roller 66 and 67.

At the beginning of the loading process, blank 24, which rests on a stand 68, is picked up by mechanism 23, and pressure-application roller 67 is pivoted away from the end piece 45 on loading arm 21.

Motor 17 is then switched on and lifts column 13, positioning beam 15, pickup mechanism 23, and blank 24 through an interval 69.

Loading arm 21 is then accelerated from standstill to a displacement velocity $V_1$ through strokes 51 and 53 by displacement cylinders 47 and 49. Due to the friction between positioning beam 15 and loading arm 21, displacement velocity $V_1$ decreases slightly through displacement range 70 to a displacement velocity $V_2$.

Loading arm 21 is decelerated from displacement velccity $V_2$ to standstill through strokes 50 and 52 by displacement cylinders 46 and 48.

With loading arm 21 at limit 59, pressure-application cylinder 62 is activated, forcing pressure-application roller 66 against end piece 44.

Blank 24 is then deposited on lower tool 7, pressure-application roller 66 is pivoted away from end piece 44, and loading arm 21 is accelerated from standstill to a displacement velocity $V_3$ over strokes 50 and 52 by displacement cylinders 46 and 48.

Loading arm 21, which has been decelerated to a slightly lower displacement velocity $V_4$ due to the friction situation in displacement range 70, is then decelerated to standstill over strokes 51 and 53 by displacement cylinders 47 and 49.

Loading arm 21 is then retained in a prescribed horizontal position by the pressure of pressure-application roller 57 against end piece 45.

Column 13, positioning beam 15, loading arm 21, and pickup mechanism 23 are then lowered over interval 69. In this position pickup mechanism 23 is ready to pick up a new blank.

As soon as loading arm 21 leaves the vicinity of press 2, the blank 24 on lower forming tool 7 is pressed into a shape by the downward displacement of upper forming tool 9.

The finished shape is then, with press 2 open, conveyed by unloading mechanism 4 from lower forming tool 7 to a stand 71.

The motions of unloading arm 25 are identical to those of loading arm 21.

We claim:

1. An arrangement for manufacturing presses shapes and similar structures comprising: a press with loading means and unloading means; a loading arm with a displacement path for loading the press; displacement drive means with driving power for driving said loading arm; an unloading arm with a displacement path for unloading the press; displacement drive means with driving power for driving said unloading arm; each said displacement means comprising at least two displacement cylinders having strokes shorter than either the displacement path of the loading arm or the displacement path of the unloading arm; transmission of force being inhibited from said cylinders to said loading arm and said unloading arm for minimum use of driving power during acceleration intervals when said loading and unloading arms move from a stationary position to displacement speed.

2. An arrangement as defined in claim 1, including two pressure-application means associated with each displacement drive means for maintaining said loading arm and said unloading arm at limits of their displacement paths.

3. An arrangement as defined in claim 2, wherein each pressure-application means has a pressure-application cylinder and a pressure-application lever.

4. An arrangement as defined in claim 3, wherein each pressure-application lever has a pressure-application roller.

5. An arrangement as defined in claim 1, wherein each displacement cylinder comprises a pneumatic cylinder.

6. An arrangement for manufacturing pressed shapes and similar structures comprising: a press with loading means and unloading means; a loading arm with a displacement path for loading the press; displacement drive means with driving power for driving said loading arm; an unloading arm with a displacement path for unloading the press; displacement drive means with driving power for driving said unloading arm; each said displacement means comprising at least two displacement cylinders having strokes shorter than either the displacement path of the loading arm or the displacement path of the unloading arm; transmission of force being inhibited from said cylinders to said loading arm and said unloading arm for minimum use of driving power during acceleration intervals when said loading and unloading arms move from a stationary position to displacement speed; two pressure-application means associated with said displacement drive means for maintaining said loading arm and said unloading arm at limits of their displacement paths; each pressure-application means having a pressure-application cylinder and a pressure-application lever; said pressure-application lever having a pressure-application roller; each displacement cylinder comprising a pneumatic cylinder.

7. An arrangement for manufacturing pressed shapes and similar structures comprising: a hydraulic press with loading means and unloading means; a frame with a lower cross arm having a lower forming tool mounted thereon; a displaceable press cross arm with an upper forming tool; a pressure-application cylinder for driving said displaceable press cross arm; said loading means and said unloading means having a respective extension arm secured to said frame; a raisable and lowerable column and a positioning beam in said loading means and said unloading means, each column being rigidly secured to the positioning beam; motor means for raising and lowering said columns; a loading arms with means for picking up and laying down a blank; said positioning means in said loading means comprising a horizontal guide for said loading arm; displacement drive means on said positioning beam in said loading means; an unloading arm with means for picking up and laying down a finished shape; said positioning beam in said unloading means comprising a horizontal guide for said unloading arm; displacement drive means in said unloading means and held by the positioning beam in said unloading means; each positioning beam having eight positioning rollers with horizontal axes of rotation and for positioning rollers with vertical axes of rotation; said loading arm and said unloading arm having each three lengths of structural section with a triangular cross-section and two end members; each displacement drive means comprising four displacement cylinders with strokes shorter than either the displacement path of said loading arm or the displacement path of said unloading arm; said displacement cylinders comprising pneumatic cylinders; two pressure-application means associated with said displacement drive means for maintaining saidloading arm and said unloading arm in their limiting positions; each pressure-application means having a pressure-application cylinder and pressure-application lever with a pressure-application roller.

* * * * *

UNITED STATES PATENT AND TRADEMARK OFFICE

CERTIFICATE OF CORRECTION

PATENT NO. : 4,770,024

DATED : September 13, 1988

INVENTOR(S) : Sauerwald et al

It is certified that error appears in the above-identified patent and that said Letters Patent is hereby corrected as shown below:

Insert Figure 3 as shown on the attached sheet.

Signed and Sealed this

Twenty-third Day of May, 1989

*Attest:*

*Attesting Officer*

DONALD J. QUIGG

*Commissioner of Patents and Trademarks*